US006598773B1

(12) United States Patent
Daret et al.

(10) Patent No.: US 6,598,773 B1
(45) Date of Patent: Jul. 29, 2003

(54) TICKET DISPENSING APPARATUS

(75) Inventors: Dominique Daret, Montrouge (FR); Frédéric Mazel, Montrouge (FR); Richard Arrufat, Bagneux (FR); Eric Thevenet, Paris (FR)

(73) Assignee: Axiohm, Montrouge (FR)

( * ) Notice: Subject to any disclaimer, the term of this patent is extended or adjusted under 35 U.S.C. 154(b) by 0 days.

(21) Appl. No.: 09/869,944

(22) PCT Filed: Nov. 9, 2000

(86) PCT No.: PCT/FR00/03122

§ 371 (c)(1),
(2), (4) Date: Jul. 2, 2001

(87) PCT Pub. No.: WO01/37223

PCT Pub. Date: May 25, 2001

(30) Foreign Application Priority Data

Nov. 19, 1999 (FR) ..... 99 14595

(51) Int. Cl.[7] ..... G07B 5/02

(52) U.S. Cl. ..... 225/73; 225/23; 225/51; 225/82; 225/89

(58) Field of Search ..... 225/6, 9, 19, 23, 225/51, 52, 54, 67, 68, 72, 73, 82, 89, 75

(56) References Cited

U.S. PATENT DOCUMENTS 1,173,795 A * 2/1916 Bokor et al. ..... 225/82
2,574,175 A * 11/1951 Erhardt ..... 225/54
2,594,391 A * 4/1952 Cardall ..... 225/89
3,033,432 A * 5/1962 Code ..... 225/51
3,915,364 A * 10/1975 Dieguez ..... 225/54
4,579,267 A 4/1986 Planke ..... 225/54
6,152,344 A * 11/2000 Jensen ..... 225/23

FOREIGN PATENT DOCUMENTS

EP 0610116 8/1994
GB 2082973 3/1982

* cited by examiner

*Primary Examiner*—Hwei-Siu Payer
(74) *Attorney, Agent, or Firm*—George R. McGuire; Hancock & Estabrook, LLP

(57) ABSTRACT

A device for dispensing tickets from a continuous strip of paper (1), each ticket being constituted by an end segment of the strip suitable for being grasped by a recipient of the ticket and detached by applying traction to said end, the device comprising a mechanism for pinching the paper along a line (3) extending transversely across the strip (1), and downstream from this mechanism, a cutting blade (4) extending substantially transversely across the strip, with the strip bearing against the cutting edge (5) of the blade when the above-mentioned traction is applied, wherein the cutting edge (5) of the blade is formed by a straight-line segment that intersects the plane of the strip of paper (1) in contact with the blade (4) prior to cutting and containing the pinch line (3), with the projection (7) of the blade onto said plane converging towards the pinch line (3) from the point (6) where the paper first comes into contact with the blade (4).

4 Claims, 2 Drawing Sheets

TICKET DISPENSING APPARATUS

The present invention relates to a device for dispensing tickets, each being constituted by a segment detached from a continuous strip of paper. More precisely, the device of the invention is associated with a machine for printing tickets that constitute a receipt or a written record of a transaction such as a payment by means of a credit card. Still more precisely, one particular application of the device lies in being associated with a thermal printer.

There are two main varieties of ticket-dispensing machines: those in which the ticket is presented to the recipient already detached or predetached from the strip from which it is derived, and those in which the ticket is presented while still attached to the strip and it is by pulling on the ticket that it becomes detached from the strip where it passes over the sharp knife edge of a cutting blade. Machines of the second variety present the advantage of having cutting apparatus that is static, i.e. without any moving part, and thus simpler to maintain and operating without any need for power to be fed to move a moving cutting blade. In contrast, their drawback lies in the absence of a sharp and clean cut. The parting line is usually serrated or at an angle, and the tape is torn rather than being cut by the blade. If the blade had a sharp knife edge instead of serrations, then a difficulty arises at the point where cutting starts since cutting must start cleanly and must occur whatever the traction force applied to the ticket by its recipient. The most recent state of the art in this field consists in providing a V-shaped blade with a central point where the paper begins to be cut when the recipient pulls the paper. However, such a blade is complex and expensive to manufacture.

The invention proposes obtaining a cut that even if no better than that of a pointed blade is at least equivalent thereto, and to do with a blade that is much less expensive since it is straight-edged. The blade can have a cutting knife edge that is linear or serrated.

To this end, the invention relates to a device for dispensing tickets from a continuous strip of paper, each ticket being constituted by an end segment of the strip suitable for being grasped by a recipient of the ticket and detached by applying traction to said end, the device comprising a mechanism for pinching the paper along a line extending transversely across the strip, and downstream from this mechanism, a cutting blade extending substantially transversely across the strip, with the strip bearing against the cutting edge of the blade when the above-mentioned traction is applied. According to the invention, the cutting edge of the blade is formed by a straight-line segment that intersects the plane of the strip of paper in contact with the blade prior to cutting and containing the pinch line, with the projection of the blade onto said plane converging towards the pinch line from the point where the paper first comes into contact with the blade.

In other words, if the strip of paper is horizontal between the pinch line and the cutting blade, then the cutting edge of the blade slopes downwards and towards the pinch line. These two slopes make it possible firstly to create a cutting point at a location where traction force is concentrated when the segment of strip to be detached is pulled, thereby ensuring that cutting is started cleanly (at the high point of the blade), while its slope towards the pinch line is provided to correct for the angled line of cut that would normally arise from a blade having its cutting edge sloping in a vertical plane parallel to the pinch line.

When the device of the invention is associated with a thermal printer, the pinch line is the line of contact between the print head and the paper-driving capstan beneath it. It is not unusual for the force exerted by the print head on the capstan to be insufficient to ensure that the paper is properly pinched, and as a result it can happen that paper is allowed to slide while it is being cut. The paper is also retained by friction between the portion thereof which is wrapped around the capstan since the capstan is made of a material to which paper "adheres" if only to ensure that the capstan can drive it. The traction force, at least before cutting starts, is thus exerted in disadvantageous manner on the capstan which is subjected to interfering forces which, in the long run, harm proper operation thereof.

To remedy that, according to a feature of the invention, the blade is secured to a support mounted to pivot about a fixed axis substantially parallel to a straight line extending transversely relative to the strip of paper and situated beneath the cutting edge, being set back therefrom, said support presenting, upstream from the cutting blade, a jaw-forming portion which advances towards the strip to come against a fixed abutment when the end of the strip is subjected to the above-mentioned traction. This jaw and this abutment form an additional pinch mechanism which either prevents the paper sliding while it is being cut, or at least relieves the capstan of part of the traction force that results from the recipient taking hold of the ticket.

Other characteristics and advantages of the invention appear from the following description of various embodiments.

Reference is made to the accompanying drawings, in which.

Figure 1:
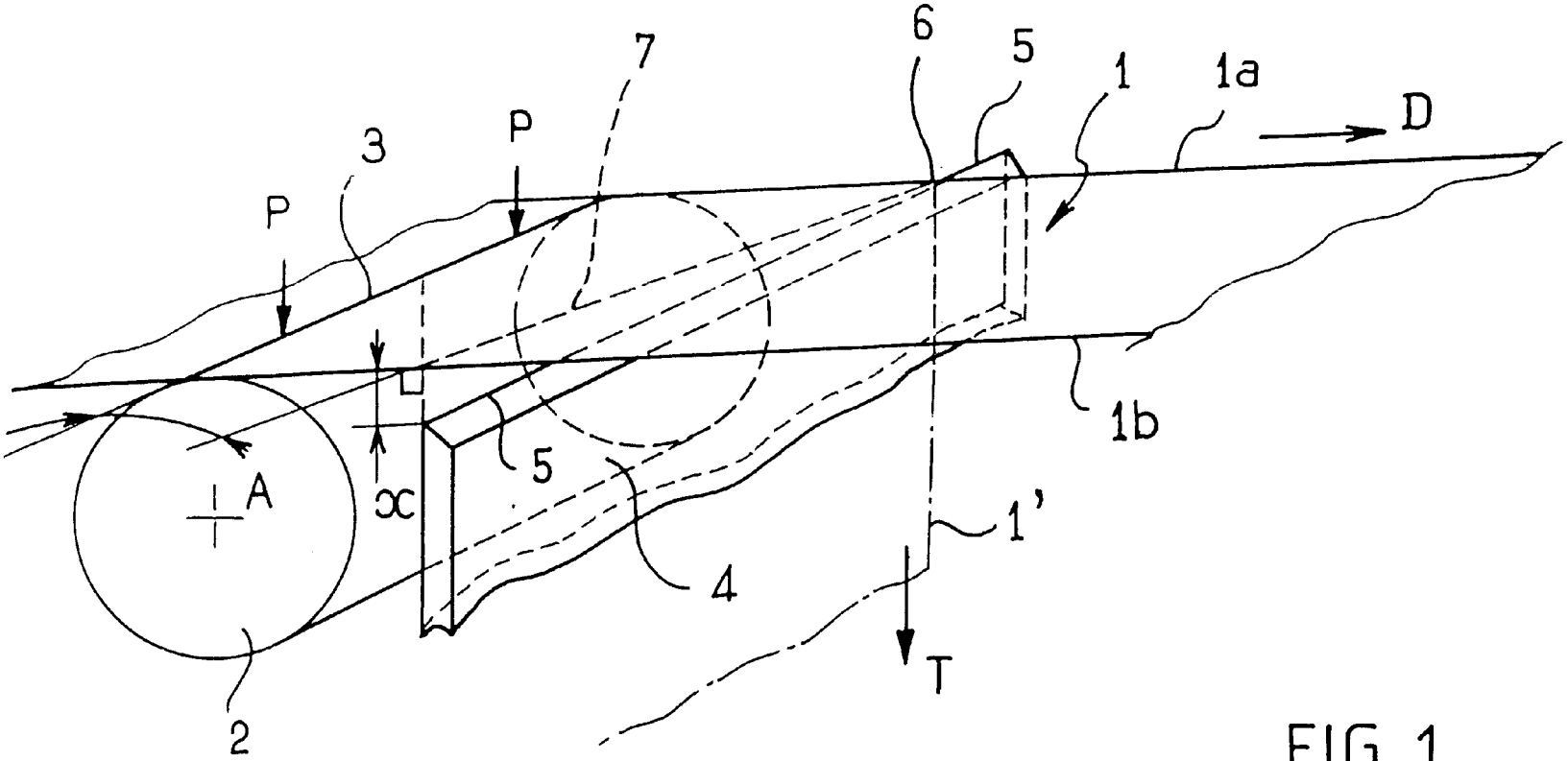
FIG. 1 is a diagram showing a characteristic of the invention.

FIG. 1 shows a strip of paper 1 which passes over a roller 2. The strip of paper can be pinched (arrows P) along a generator line of the roller. Beyond the roller, in the travel direction D of the strip, it passes over a cutting blade 4 which extends substantially transversely relative to the strip. This cutting blade has a sharp or cutting edge 5 (a knife edge), shown here as having no serrations.

In order to ensure that cutting is started properly when the strip of paper is pulled downwards, thus causing the paper to be folded to position 1' about the cutting blade 4, it is necessary for the traction force T to be concentrated at a single point of contact between the blade and the strip of paper. To do this, the knife edge 5 of the blade is formed by a straight-line segment which intersects the plane that is tangential to the roller 2, that contains the strip of paper, and that includes the pinch line 3. In other words, when in FIG. 1 the strip of paper is pulled in the substantially horizontal direction D, the knife edge of the blade 5 is in contact with the side 1*a* of the strip of paper, whereas the knife edge is situated well below the opposite side 1*b* of the paper (gap x). The point of contact 6 between the strip and the blade thus constitutes a point where cutting starts when the strip is folded downwards and traction T is applied thereto.

It will be understood that if the blade 4 extended accurately perpendicularly to the strip of paper 1, then the effect of cutting taking place progressively along the knife edge 5 from the side 1*a* to the side 1*b*, would be to cause the point of intersection between the knife edge 5 and side 1*b* to be situated further from the pinch line 3 than the point 6. This would result in the strip being cut along a line that does not extend across it exactly perpendicularly.

To correct this defect, the cutting blade is made to slope towards the pinch line 3 so that its portion situated beneath the side 1*b* of the strip 1 is closer to said pinch line so that the point of intersection between the knife edge 5 and the side 1*b* is at the same distance from the line 3 as is the point 6. To express this in geometrical terms, the knife edge 5 of the cutting blade is said not only to intersect the plane of the strip containing the pinch line 3, but also that its projection 7 onto this plane converges on said pinch line. The angle of convergence A is naturally only a few degrees (it is exaggerated in the diagram of FIG. 1).

Figure 2:
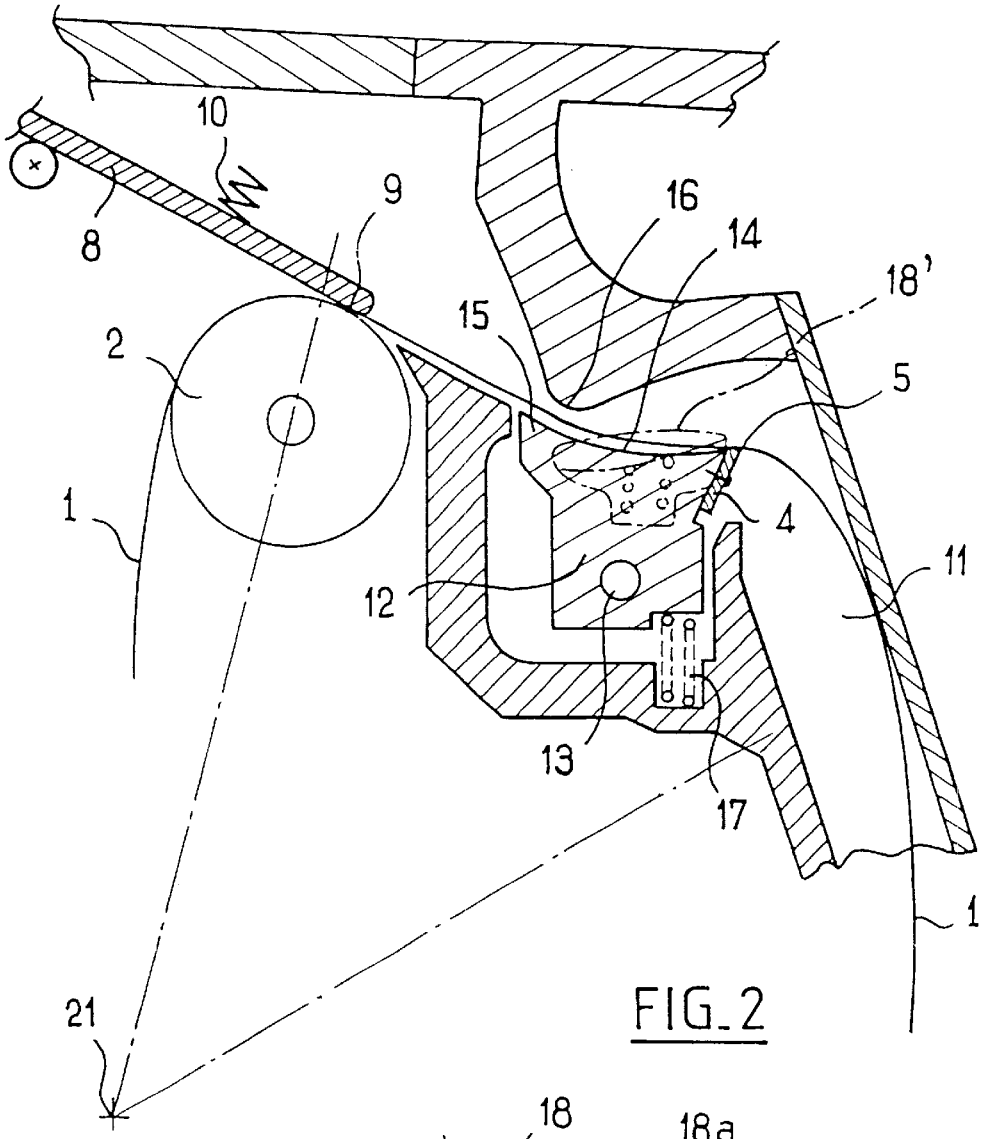
FIGS. 2 and 3 are simplified views of two variant embodiments of the cutting mechanism of the invention associated with a thermal printer.

FIG. 2 shows some of the elements described above and they are given the same references. The roller 2 constitutes the capstan of a thermal printer whose print head is reference 8 and has a line of heater points 9 urged resiliently against the roller 2 by a resilient member 10. On leaving the thermal printer, the strip of paper 1 is passed into a chute 11 at the end of which it can be grasped by the user.

The cutter device of the invention is situated at the entrance to the chute 11, so as to project into the path followed by the paper, thereby ensuring that the paper comes cleanly into contact with the cutting blade when it is pulled.

The cutting blade 4 is carried by (or is integral with) a support 12 which is mounted to pivot about an axis 13 extending substantially parallel to a straight line at right angles to the strip of paper and set back from the cutting knife edge 5 of the blade so that traction on the paper as transmitted to the blade and to the support generates pivoting torque on the blade about the axis 13. The support has a top surface 14 forming a paper guide at the entrance to the chute 11, said surface 14 being defined downstream by the cutting blade 4 (or a cutting edge of the support itself) and upstream by a portion 15 situated facing an abutment 16 which forms the entrance to the chute 11. The relative postion of the knife edge 5 of the blade 4 and the axis 13 is such that when the strip of paper 1 is pulled from outside the chute 11, the support 12 can tilt in a clockwise direction inside the chute 11 until the portion 15 comes into contact with the abutment 16. A resilient return member 17 acts on the support 12 to move the jaw 15 away from the abutment 16 when the traction force ceases to be applied.

It will be understood that at the end of the printing, when the user seeks to obtain a ticket, the user pulls on the end of the strip 1 that is presented, thereby causing the support 12 to tilt until the portion 15 pinches the strip against the abutment 16. The strip segment is then cut off by the knife edge 5 of the blade 4 and at the end of cutting, the spring 17 moves the jaw 15 away from the abutment 16. A coating can be provided on one or other of the surfaces of the jaw 15 and the abutment 16 that come into contact with the paper so as to enhance the tension of the paper when these two portions come into contact.

Figure 3:
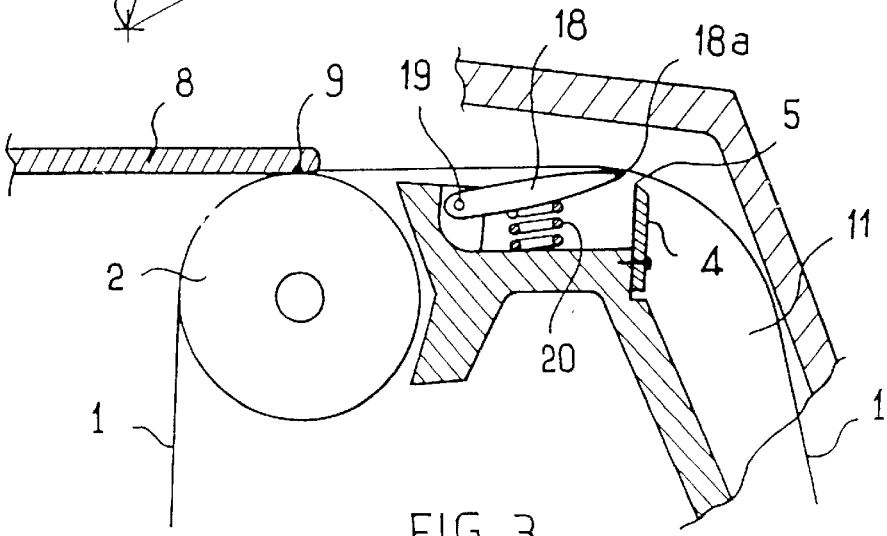

FIG. 3 shows a variant embodiment of the ticket dispenser of the invention in which certain elements that are described above are given the same references. In this variant, adhesion of the strip of paper on the roller 2 of the thermal printer is assumed to be sufficient to withstand the traction exerted on the strip when dispensing a ticket. The cutting blade 4 in this case is fixed relative to the elements of the frame which define the chute 11, and it is situated at the entrance of the chute, projecting into the path of the paper. It is in the form of a fine blade fitted to a portion of the frame of the device defining the entrance to the chute. The surface for guiding the paper between the outlet from the thermal printer and the inlet to the chute 11 is formed, at least in part, by the top face of a flap 18 situated upstream from the blade 4 and pivotally mounted along its knife edge furthest from the blade 4 about an axis 19 that is substantially parallel to a line extending at right angles across the strip of paper, while its free and 18*a* adjacent to the blade 4 forms a sliding surface for the strip of paper that is situated at a level that is higher than the level of the cutting knife edge 5 such that when no traction is applied to the strip of paper, after a ticket has been cut off, the leading knife edge of the strip can advance into the chute 11 under drive from the roller 2 without coming into abutment against the blade 4. When traction is exerted on the strip of paper, this sliding surface as formed by the flap 18 can retract at least to the level of the cutting knife edge of the blade 4, against a resilient return member 20, thereby allowing the paper to come into contact with the cutting knife edge of the blade 4.

In FIG. 2, chain-dotted lines referenced 18'show a similar arrangement included in the support 12 on which the blade 4 is pivoted.

In a variant embodiment of the flap 18, an elastically flexible tongue such as a spring blade possessing its own return effect can be provided embedded at one end in the frame beside the capstan while its free end is close to the blade 4 and tends to move into the chute so as to come to rest in abutment against fixed abutments on either side of the strip of paper in the vicinity of the blade 4, and keeping this free end at a level that is slightly above the level of the knife edge of the blade.

The device of the invention can be suitable for being opened, i.e. given that the strip of paper comes from a roll put into place in a magazine in the device, it can be convenient to be able to insert the roll after the capstan has been separated from the thermal print head. Under such circumstances, the capstan, the chute, and the cutting blade are carried by a cover which is hinged to a frame which carries the print head 8, and the hinge of the cover can be about an axis 21 (see FIG. 2) situated in such a manner relative to the line of heater points 9 of the printer 8 that the printer co-operates with the capstan to form a conventional means for locking the cover resiliently to the frame of the device.

What is claimed is:

1. A device for dispensing tickets from a continuous strip of paper, each ticket being constituted by an end segment of the strip suitable for being grasped by a recipient of the ticket and detached by applying traction to said end segment, the device comprising a mechanism for pinching the paper along a line extending transversely across the strip, and downstream from this mechanism, a cutting blade extending substantially transversely across the strip, with the strip bearing against the cutting edge of the blade when the above-mentioned traction is applied, wherein the cutting edge of the blade is formed by a straight-line segment that intersects a plane containing the strip of paper and converges towards the pinch line from said contact so that, when said traction is applied, said paper strip first comes into contact with said blade at a point located at one side edge of said strip.

2. A device according to claim 1, wherein said blade is secured to a support mounted to pivot about a fixed axis substantially parallel to a straight line extending transversely relative to the strip of paper and situated beneath the cutting edge, being set back therefrom, said support presenting, upstream from the cutting blade, a jaw-forming portion which advances towards the strip to come against a fixed abutment when the end of the strip is subjected to the above-mentioned traction, and which co-operates with said abutment to form said pinch mechanism.

3. A device according to claim 2, wherein the blade support is continuously subjected to force from a return member tending to move said jaw-forming portion away from the abutment.

4. A device according to claim 1, wherein the cutting edge is provided at the top of the blade remote from the above-mentioned pinch line, and wherein the device includes a paper guide surface between the pinch line and the cutting edge of the thin blade, which surface is formed by a flap that is retractable between a first position in which its end close to the blade is situated above the cutting edge and a second position in which said flap is situated no higher than said cutting edge, the flap being subjected to a return member tending to keep it permanently in its first position.

* * * * *